US010245843B2

(12) United States Patent
Matsusaki

(10) Patent No.: US 10,245,843 B2
(45) Date of Patent: Apr. 2, 2019

(54) THERMAL HEAD AND THERMAL PRINTER

(71) Applicant: KYOCERA Corporation, Kyoto-shi, Kyoto (JP)

(72) Inventor: Yuuki Matsusaki, Kirishima (JP)

(73) Assignee: KYOCERA CORPORATION, Kyoto-Shi, Kyoto (JP)

( * ) Notice: Subject to any disclaimer, the term of this patent is extended or adjusted under 35 U.S.C. 154(b) by 0 days.

(21) Appl. No.: 15/748,331

(22) PCT Filed: Jul. 26, 2016

(86) PCT No.: PCT/JP2016/071884

§ 371 (c)(1),
(2) Date: Jan. 29, 2018

(87) PCT Pub. No.: WO2017/018415

PCT Pub. Date: Feb. 2, 2017

(65) Prior Publication Data

US 2018/0201026 A1 Jul. 19, 2018

(30) Foreign Application Priority Data

Jul. 30, 2015 (JP) ..... 2015-150914

(51) Int. Cl.

| | |
|---|---|
| ***B41J 2/335*** | (2006.01) |
| ***B41J 2/32*** | (2006.01) |
| ***B41J 2/34*** | (2006.01) |

(52) U.S. Cl.

CPC ..... *B41J 2/33585* (2013.01); *B41J 2/32* (2013.01); *B41J 2/335* (2013.01); *B41J 2/3351* (2013.01); *B41J 2/3352* (2013.01); *B41J 2/3353* (2013.01); *B41J 2/3355* (2013.01); *B41J 2/33515* (2013.01); *B41J 2/33535* (2013.01); *B41J 2/34* (2013.01); *B41J 2202/31* (2013.01)

(58) Field of Classification Search

CPC .... B41J 2/33585; B41J 2/3352; B41J 2/3355; B41J 2/33515; B41J 2/3353; B41J 2/3351; B41J 2/33535; B41J 2/34; B41J 2202/31

See application file for complete search history.

(56) References Cited

U.S. PATENT DOCUMENTS 5,485,192 A * 1/1996 Nagahata ..... B41J 2/33515 347/203

FOREIGN PATENT DOCUMENTS

| | | |
|---|---|---|
| JP | 64-030770 A | 2/1989 |
| JP | 07-132628 A | 5/1995 |
| JP | 2007-168351 A | 7/2007 |

OTHER PUBLICATIONS

Computer generated translation of JP 01-030770, published on Feb. 1989.*

International Search Report, PCT/JP2016/071884, dated Oct. 4, 2016, 1 pg.

* cited by examiner

*Primary Examiner* — Huan H Tran

(74) *Attorney, Agent, or Firm* — Volpe and Koenig, P.C.

(57) ABSTRACT

A thermal head of the disclosure includes a substrate; a heat generating section disposed on the substrate; an electrode disposed on the substrate, the electrode having a connecting portion connected to the heat generating section; and a protective layer which covers the heat generating section and the connecting portion of the electrode, a part of the protective layer which is disposed on the connecting portion having a closed first void therein.

11 Claims, 8 Drawing Sheets

THERMAL HEAD AND THERMAL PRINTER

TECHNICAL FIELD

The present invention relates to a thermal head and a thermal printer.

BACKGROUND ART

As printing devices for use in facsimiles, or video printers, etc., various types of thermal heads have been proposed to date. For example, there is known a thermal head comprising: a substrate; a heat generating section disposed on the substrate; an electrode disposed on the substrate, the electrode having a connecting portion connected to the heat generating section; and a protective layer which covers the heat generating section and the connecting portion of the electrode (refer to Patent Literature 1).

In Patent Literature 1, there is shown a description as to a way to achieve efficient transmission of heat generated in the heat generating section to a recording medium with use of the highly heat-conductive protective layer for improvement in thermal efficiency in the thermal head.

CITATION LIST

Patent Literature

Patent Literature 1: Japanese Unexamined Patent Publication JP-A 7-132628 (1995)

SUMMARY OF INVENTION

A thermal head according to the disclosure comprises: a substrate; a heat generating section disposed on the substrate; an electrode disposed on the substrate, the electrode having a connecting portion connected to the heat generating section; and a protective layer which covers the heat generating section and the connecting portion of the electrode. Moreover, a part of the protective layer which is disposed on the connecting portion has a closed first void therein.

A thermal printer according to the disclosure comprises: the thermal head mentioned above; a conveyance mechanism which conveys a recording medium onto the heat generating section; and a platen roller which presses the recording medium against a top of the heat generating section.

DESCRIPTION OF EMBODIMENTS

First Embodiment

Figure 1:
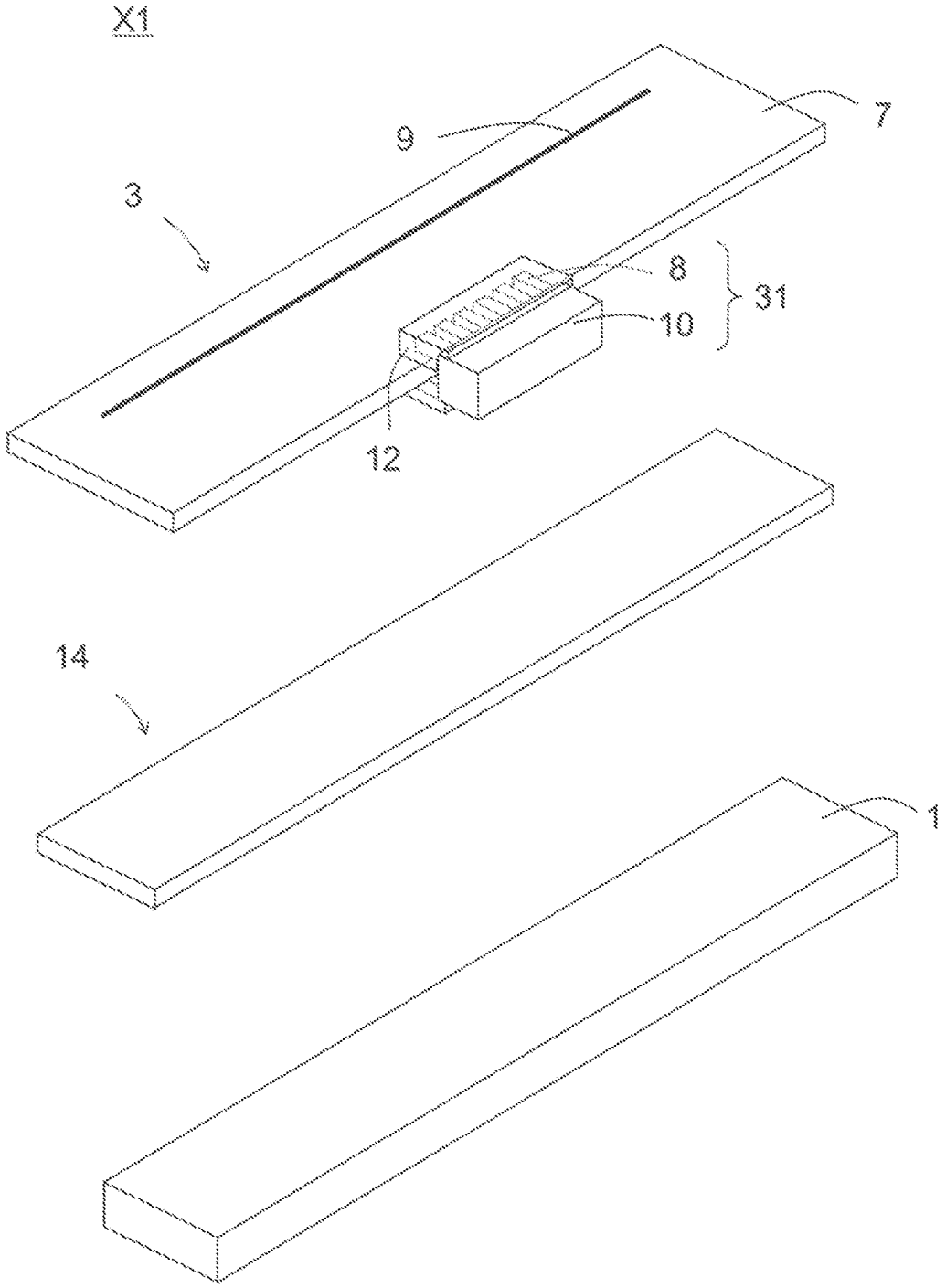
FIG. 1 is an exploded perspective view showing the general form of a thermal head according to a first embodiment.
Figure 2:
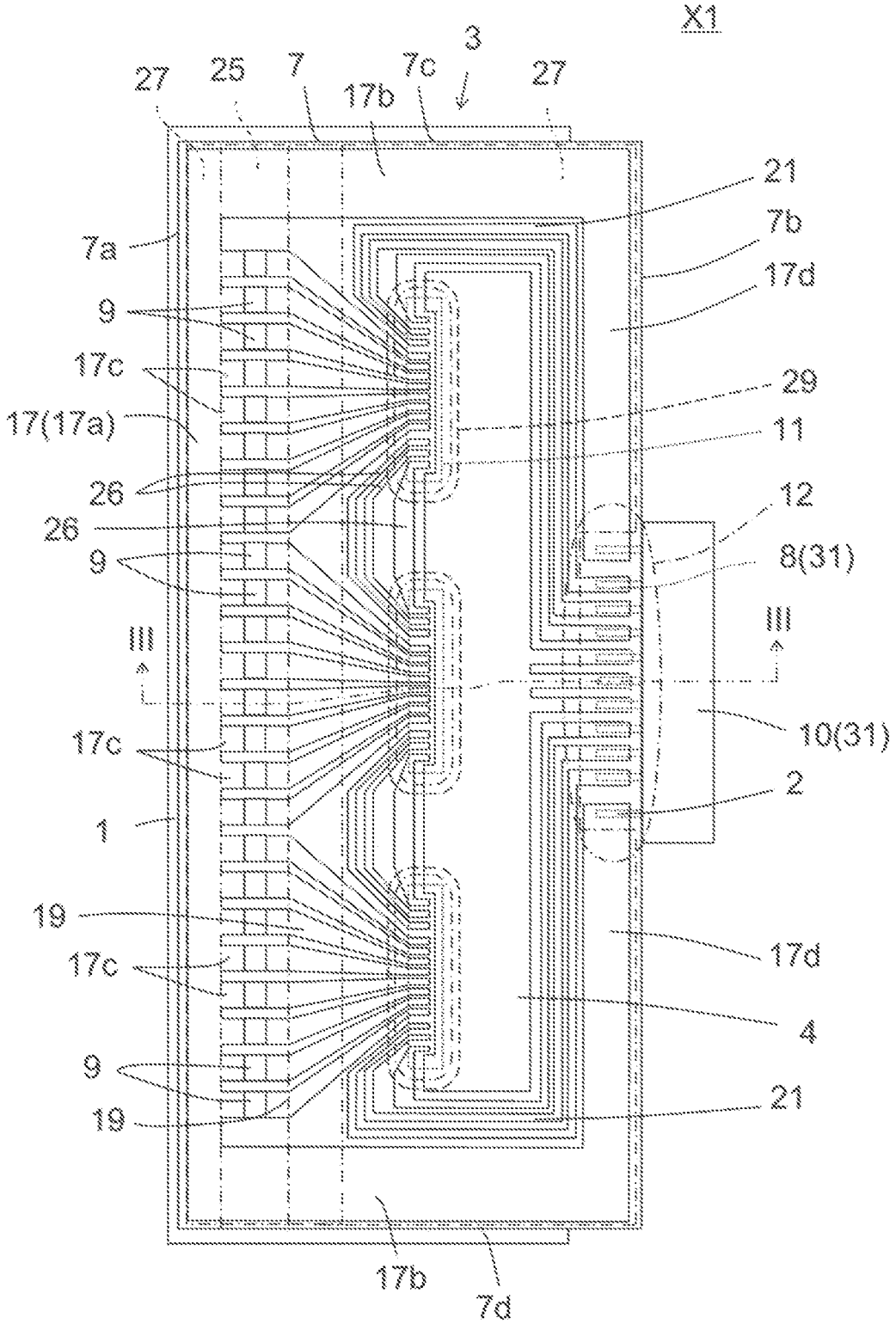
FIG. 2 is a plan view of the thermal head shown in FIG. 1.

Hereinafter, a thermal head X1 will be described with reference to FIGS. 1 to 4. FIG. 1 schematically shows the structure of the thermal head X1. In FIG. 2, a protective layer 25, a cover layer 27, and a sealing member 12 are illustrated by alternate long and short dash lines.

As shown in FIG. 1, the thermal head X1 comprises: a head base body 3; a connector 31; the sealing member 12; a heat dissipating plate 1; and a bonding member 14. In the thermal head X1, the head base body 3 is placed, via the bonding member 14, on the heat dissipating plate 1. The head base body 3 performs printing on a recording medium (not shown) by causing the heat generating section 9 to generate heat under application of external voltage. The connector 31 electrically connects the head base body 3 and the exterior thereof. The sealing member 12 joins the connector 31 and the head base body 3 together. The heat dissipating plate 1 is provided to dissipate heat evolved in the head base body 3. The bonding member 14 bonds the head base body 3 and the heat dissipating plate 1 together.

The heat dissipating plate 1 has a rectangular parallelepiped shape. The heat dissipating plate 1 is formed of a metal material such for example as copper, iron or aluminum, and functions to dissipate part of the heat evolved in the heat generating section 9 of the head base body 3 which part is not conducive to printing.

The head base body 3 has a rectangular shape as seen in plan view, and, each member constituting the thermal head X1 is disposed on a substrate 7 of the head base body 3. The head base body 3 functions to perform printing on a recording medium (not shown) in response to an externally supplied electric signal.

Figure 3:
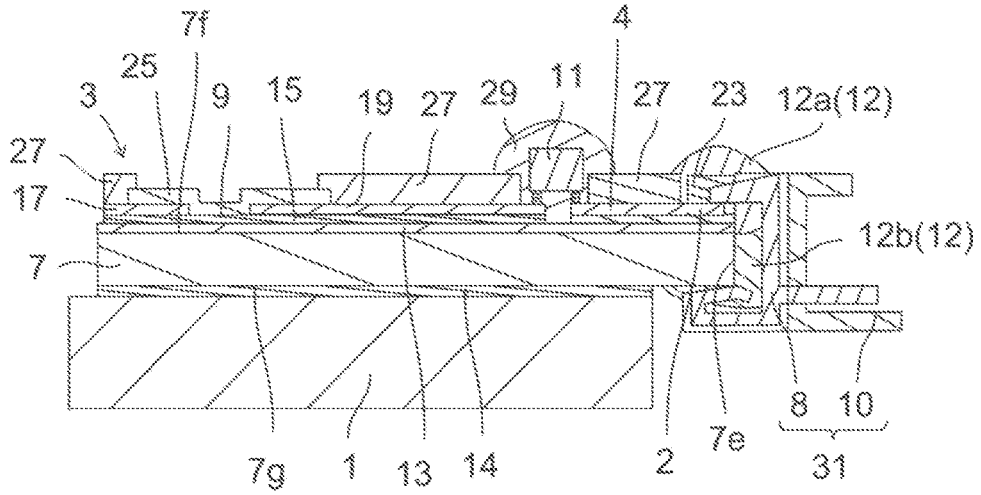
FIG. 3 is a sectional view of the thermal head taken along the line III-III shown in FIG. 2.

Now, each of the constituent members of the head base body 3 will be described with reference to FIGS. 1 to 3.

The substrate 7 is placed on the heat dissipating plate 1, and has a rectangular shape as seen in plan view. Thus, the substrate 7 is defined by a first long side 7*a*, a second long side 7*b*, a first short side 7*c*, a second short side 7*d*, a side surface 7*e*, a first principal surface 7*f*, and a second principal surface 7*g*. The side surface 7*e* is located on the connector 31 side. On the first principal surface 7*f*, the individual constituent members of the head base body 3 are provided. The second principal surface 7*g* is located on the heat dissipating plate 1 side. For example, the substrate 7 is formed of an electrically insulating material such as alumina ceramics, or a semiconductor material such as single-crystal silicon.

On the first surface 7*f* of the substrate 7, a heat storage layer 13 is provided. The heat storage layer 13 is disposed so as to extend over the entire area of the first principal surface 7*f* of the substrate 7. A height of the heat storage layer 13 from the substrate 7 is set to 15 to 90 μm.

The heat storage layer 13 is formed of glass having a low thermal conductivity, and temporarily stores part of the heat evolved in the heat generating section 9. Hence, the heat storage layer 13 is capable of shortening the time required to raise the temperature of the heat generating section 9, and thus functions to improve the thermal response characteristics of the thermal head X1.

For example, the heat storage layer 13 is formed by applying a predetermined glass paste obtained by blending a suitable organic solvent in glass powder to the upper surface of the substrate 7 by heretofore known technique such as screen printing, and thereafter firing the glass paste. The heat storage layer 13 does not necessarily have to be disposed so as to extend over the entire area of the first principal surface 7*f* of the substrate 7. For example, it is possible to place the heat storage layer 13 only in a region below the heat generating section 9.

An electrical resistance layer 15 is located on the substrate 7, as well as on the heat storage layer 13, and also, on the electrical resistance layer 15, various types of electrodes constituting the head base body 3 are provided. The electrical resistance layer 15 is patterned in the same configuration as that of each electrode constituting the head base body 3. Thus, the electrical resistance layer 15 has exposed regions, each of which is an exposed electrical-resistance-layer 15 region lying between a common electrode 17 and a discrete electrode 19. Each exposed region left exposed from the common electrode 17 and the discrete electrode 19 constitutes the heat generating section 9, and, the individual heat generating sections 9 are arranged in array form on the heat storage layer 13. The electrical resistance layer 15 may be formed only in a region between the common electrode 17 and the discrete electrode 19.

The plurality of heat generating sections 9, while being illustrated in simplified form in FIG. 2 for convenience in explanation, are arranged at a density of 100 dpi (dot per inch) to 2400 dpi, for example. The electrical resistance layer 15 is formed of a material having a relatively high electrical resistance such for example as a TaN-based material, a TaSiO-based material, a TaSiNO-based material, a TiSiO-based material, a TiSiCO-based material, or a NbSiO-based material. Hence, upon application of a voltage to the heat generating section 9, the heat generating section 9 generates heat under Joule heating effect.

The common electrode 17 comprises: main wiring portions 17*a* and 17*d*; sub wiring portions 17*b*; and lead portions 17*c*. The common electrode 17 electrically connects the connector 31 and the plurality of heat generating sections 9. The main wiring portion 17*a* extends along one long side 7*a* of the substrate 7. The sub wiring portions 17*b* extend along one short side 7*c* and the other short side 7*d*, respectively, of the substrate 7. The lead portions 17*c* extend from the main wiring portion 17*a* toward the corresponding heat generating sections 9 on an individual basis. The main wiring portion 17*d* extends along the other long side 7*b* of the substrate 7.

The plurality of discrete electrodes 19 provide electrical connection between the heat generating section 9 and a driving IC 11. Moreover, the discrete electrodes 19 allow the plurality of heat generating sections 9 to fall into a plurality of groups. The discrete electrode 19 provides electrical connection between each heat generating section 9 group and corresponding one of the driving ICs 11 assigned one to each group.

There are provided a plurality of IC-connector connection electrodes 21 for providing electrical connection between the driving IC 11 and the connector 31. The plurality of IC-connector connection electrodes 21 connected to the corresponding driving ICs 11 are composed of a plurality of wiring lines having different functions.

A ground electrode 4 is located so as to be surrounded by the discrete electrode 19, the IC-connector connection electrode 21, and the main wiring portion 17*d* of the common electrode 17. The ground electrode 4 is maintained at a ground potential of 0 to 1 V.

A connection terminal 2 is located on the other long side 7*b* side of the substrate 7 to connect the common electrode 17, the discrete electrode 19, the IC-connector connection electrode and the ground electrode 4 to the connector 31. The connection terminal 2 is disposed corresponding to a connector pin 8, and the connector pin 8 and the connection terminal 2 are connected to each other so that each becomes electrically independent at the time of establishing connection with the connector 31.

A plurality of IC-IC connection electrodes 26 electrically connects adjacent driving ICs 11. The plurality of IC-IC connection electrodes 26 are each disposed corresponding to the IC-connector connection electrode 21. IC-IC connection electrode 26 transmits various signals to the adjacent driving ICs 11.

For example, various electrodes constituting the head base body 3 described above are formed by laminating layers of materials for constituting the different electrodes one after another on the heat storage layer 13 by thin-film forming technique such as sputtering, and thereafter working the resultant laminate body into predetermined patterns by heretofore known technique such as photoetching. The various electrodes constituting the head base body 3 may be formed at the same time through common procedural steps.

As shown in FIG. 2, the driving IC 11 is connected to the other end of the discrete electrode 19 and one end of the IC-connector connection electrode 21. The driving IC 11 functions to control the current-carrying condition of each heat generating section 9. As the driving IC 11, a switching member having a plurality of built-in switching elements may be used.

The driving IC 11, while being connected to the discrete electrode 19, the IC-IC connection electrode 26, and the IC-connector connection electrode 21, is sealed with a hard coating 29 formed of resin such as epoxy resin or silicone resin.

The protective layer 25 is disposed on the one long side 7*a* side of the substrate 7 to cover the heat generating section 9, part of the common electrode 17, and part of the discrete electrode 19.

The protective layer 25 serves to protect the heat generating section 9 and the covered areas of the common electrode 17 and the discrete electrode 19 against corrosion caused by adhesion of atmospheric water content, etc., or against wear caused by contact with a recording medium under printing. Moreover, it is preferable that the protective layer 25 has high thermal conductivity in the interest of efficient transmission of heat to a recording medium P (refer to FIG. 5).

For example, the protective layer 25 may be formed of SiN, $SiO_2$, SiON, SiC, or diamond-like carbon, etc. The protective layer 25 may be composed either of a single layer or of a stack of layers of these materials. Such a protective layer 25 may be produced by thin-film forming technique such as sputtering or ion plating, or thick-film forming technique such as screen printing.

On the substrate 7, there is provided a cover layer 27 which partly covers the common electrode 17, the discrete electrode 19, and the IC-connector connection electrode 21. The cover layer 27 serves to protect the covered areas of the common electrode 17, the discrete electrode 19, the IC-IC connection electrode 26, and the IC-connector connection electrode 21 against oxidation caused by exposure to air, or corrosion caused by adhesion of atmospheric water content, etc. The cover layer may be formed of a resin material such as epoxy resin, polyimide resin, or silicone resin.

The connector 31 and the head base body 3 are secured to each other via the connector pin 8, a conductive member 23, and the sealing member 12. The conductive member 23 is disposed between the connection terminal 2 and the connector pin 8, and, exemplary of the conductive member 23 is solder or an anisotropic conductive adhesive. A Ni-, Au-, or Pd-plating layer (not shown in the drawings) may be interposed between the conductive member 23 and the connection terminal 2. The conductive member 23 does not necessarily have to be provided. That is, the connector pin 8 may be connected directly to the connection terminal 2.

The connector 31 comprises the plurality of connector pins 8 and a housing 10 which receives the plurality of connector pins 8. Each of the plurality of connector pins 8 has one side exposed from the housing 10, and another side received within the housing 10. The plurality of connector pins 8 are electrically connected to the connection terminal 2 of the head base body 3.

The sealing member 12 comprises a first sealing member 12*a* and a second sealing member 12*b*. The first sealing member 12*a* is located on the first principal surface 7*f* of the substrate 7. The first sealing member 12*a* is disposed so as to seal the connector pin 8 and the various electrodes. The second sealing member 12*b* is located on the second principal surface 7*g* of the substrate 7. The second sealing member 12*b* is disposed so as to seal an area where the connector pin 8 and the substrate 7 make contact with each other.

The sealing member 12 is provided so as not to expose the connection terminal 2 and the connector pin 8 to the outside, and may be formed of a thermosetting epoxy resin, an ultraviolet-curable resin, or a visible light-curable resin, for example. The first sealing member 12*a* and the second sealing member 12*b* may be formed either of the same material or of different materials.

The bonding member 14 is placed on the heat dissipating plate 1 to bond the second principal surface 7*g* of the head base body 3 with the heat dissipating plate 1. Exemplary of the bonding member 14 is a double-faced tape or a resin-based adhesive.

Figure 4:
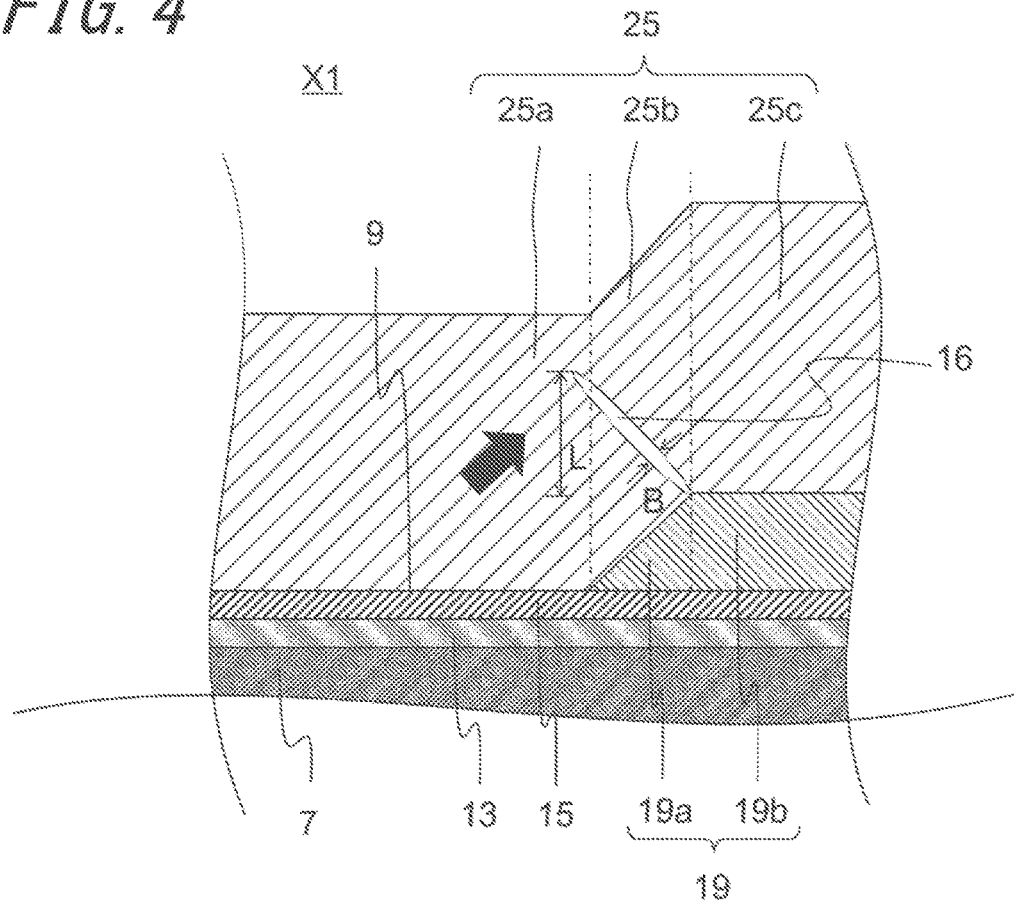
FIG. 4 is an enlarged sectional view showing the vicinity of a heat generating section as shown in FIG. 3.

Referring to FIG. 4, a detailed description will be given below as to the protective layer 25 in the vicinity of the heat generating section 9. In FIG. 4, there is shown a part of the heat generating section 9 which is close to a connecting portion of the discrete electrode 19 in enlarged dimension. Note that a common electrode 17-side part of the heat generating section 9 is similarly configured. Moreover, in FIG. 4, a black thick arrow schematically represents how part of the heat generated in the heat generating section 9 is to be transmitted through the interior of the protective layer 25, and, the same holds true for FIGS. 6 to 10.

The discrete electrode 19 comprises a connecting portion 19*a* and a wiring portion 19*b*. The connecting portion 19*a* is connected to the heat generating section 9, and is shaped so that a thickness thereof becomes smaller gradually with approach toward the heat generating section 9. The wiring portion 19*b* is electrically connected to the heat generating section 9 through the connecting portion 19*a*. The connecting portion 19*a* does not necessarily have to be inclined rectilinearly at a certain angle of inclination as shown in FIG. 4. That is, the connecting portion 19*a* may be inclined curvilinearly with gradual changes in the angle of inclination. The connecting portion 19*a* is a part of the discrete electrode 19 which extends between an end thereof and a location spaced about 1 to 3 μm away from the end.

Since the connecting portion 19*a* is shaped so that a thickness thereof becomes smaller gradually with approach toward the heat generating section 9, part of the heat generated in the heat generating section 9 is less likely to be transmitted to the connecting portion 19*a*. Hence, the heat produced in the heat generating section 9 is less likely to be dissipated from the discrete electrode 19. This can improve thermal efficiency in the thermal head X1.

The protective layer 25 is disposed so as to cover a part of the common electrode 17 which is close to the heat generating section 9, a part of the discrete electrode 19 which is close to the heat generating section 9, and the heat generating section 9. The protective layer 25 has a first region 25*a*, a second region 25*b*, and a third region 25*c*. The first region 25*a* is a region located on the heat generating section 9. The second region 25*b* is a region located on the connecting portion 19*a*. The third region 25*c* is a region located on the wiring portion 19*b*.

The protective layer 25 has a first void 16 therein. More specifically, the first void 16 lies in the first region 25*a* and in the second region 25*b* as well. That is, part of the first void 16 is located within the first region 25*a*, and the remaining part of the first void 16 is located within the second region 25*b*. The first void 16 is surrounded by the protective layer 25 corresponding to the first region 25*a* and the second region 25*b*. Thus, the first void 16 is not in communication with the outside.

The first void 16 is disposed so as to extend obliquely upwardly from a corner of the connecting portion 19*a*, as seen in sectional view. For example, the first void 16 may have a width W of 0.1 to 1 μm, and a length L in a thickness direction of the substrate 7 of 1 to 15 μm in length L. The first void 16 extends in planar form from the plane of section toward the back. Note that the first void 16 does not necessarily have to extend in planar form, and may be disposed so as to extend linearly at the plane of section.

The first void 16 is spaced away from the surface of the protective layer 25, and is thus confined within the protective layer 25 in a closed state without communication with the outside. Hence, the first void 16 is lower in thermal conductivity than the second region 25*b*, and thus serves as a heat-insulating portion within the second region 25*b*.

The first void 16 contains a gas therein. Exemplary of the gas are air, nitrogen gas, and argon gas.

The thermal head X1 performs printing operation by transmitting heat generated in the heat generating section 9 under Joule heating effect to a recording medium. The heat generated in the heat generating section 9 is transmitted upwardly through the first region 25*a* of the protective layer 25, and also, part of the heat is transmitted in a sub-scanning direction through the second region 25*b* and the third region 25*c*. The heat in a condition of being transmitted in the sub-scanning direction is dissipated from the discrete electrode 19, which results in deterioration in thermal efficiency in the thermal head X1.

In this regard, the thermal head X1 has the first void 16 existing in a closed state within the second region 25*b* of the protective layer 25. Hence, the first void 16 serves as a heat-insulating portion, wherefore the protective layer 25 is provided at the second region 25*b* thereof with the heat-insulating portion.

In consequence, even if part of the heat generated in the heat generating section 9 is about to be transmitted toward the second region 25*b* as indicated by the arrow shown in FIG. 4, part of the heat is insulated by the first void 16, and is thus less likely to be transmitted to the second region 25*b*. Hence, part of the heat generated in the heat generating section 9 is less likely to be dissipated from the discrete electrode 19, wherefore the thermal head X1 achieves improvement in thermal efficiency.

The insulation of part of the heat generated in the heat generating section 9 by the first void 16 facilitates retention of the heat generated in the heat generating section 9 within the first region 25*a*. In consequence, the heat generated in the heat generating section 9 can be transmitted efficiently to a recording medium, thus increasing the thermal efficiency of the thermal head X1.

Since the first void 16 is present in a closed state within the protective layer 25, external moisture, etc. is less likely to enter the first void 16, wherefore the heat-insulating capability of the first void 16 can be maintained. Moreover, since the possibility of intrusion of external moisture, etc. into the first void 16 can be reduced, it is possible to ensure the sealability of the protective layer 25, and thereby corrosion is less likely to occur in the common electrode 17 and the discrete electrode 19.

With the placement of the first void 16 in the second region 25*b*, even if the second region 25*b* is subjected to a thermal stress resulting from the heat generated in the heat generating section 9, the thermal stress can be relaxed by the first void 16.

Moreover, since a gas such as air is present in the first void 16, the thermal conductivity of the first void 16 can be further reduced, and part of the heat generated in the heat generating section 9 is less likely to be transmitted to the second region 25*b*.

Moreover, the first void 16 is disposed so as to extend in the thickness direction of the substrate 7. In other words, the first void 16 extends obliquely upwardly toward the surface of the protective layer 25 located on the substrate 7. This permits efficient insulation of part of the heat generated in the heat generating section 9. That is, with the second region 25*b* disposed adjacent the first region 25*a*, part of the heat generated in the heat generating section 9 is transmitted in the sub-scanning direction. In this regard, the first void 16 extends in the thickness direction of the substrate 7 so as to be intersected by the sub-scanning direction, wherefore part of the heat generated in the heat generating section 9 can be insulated efficiently.

For example, the protective layer 25 may be formed by the following procedure.

On the substrate 7 patterned with the various electrodes, the protective layer 25 is formed by sputtering technique. To begin with, a film of the protective layer 25 is formed by non-bias sputtering technique at a faster-than-normal film-forming rate. At this time, owing to the difference in level between the connecting portion 19*a* of the discrete electrode 19 and the electrical resistance layer 15, and also to the film-forming rate, the first void 16 is created near the boundary between the first region 25*a* and the second region 25*b*.

Next, a film of the protective layer 25 is formed by bias sputtering technique at a normal film-forming rate so as to be laminated onto the protective layer 25 film formed by the non-bias sputtering technique. In the case of forming the protective layer 25 by the bias sputtering technique, a dense protective layer 25 can be formed on the first void 16. This makes it possible to form the closed first void 16 in the protective layer.

Next, a thermal printer Z1 will be described with reference to FIG. 5.

The thermal printer Z1 according to the embodiment comprises: the thermal head X1 described above; a conveyance mechanism 40; a platen roller 50; a power supply device 60; and a control unit 70. The thermal head X1 is attached to a mounting face 80*a* of a mounting member 80 disposed in a housing (not shown) for the thermal printer Z1. The thermal head X1 is mounted on the mounting member 80 so as to be oriented along the main scanning direction which is perpendicular to a conveying direction S of the recording medium P which will hereafter be described.

The conveyance mechanism 40 comprises a driving section (not shown) and conveying rollers 43, 45, 47 and 49. The conveyance mechanism 40 serves to convey the recording medium P such as thermal paper or ink-transferable image-receiving paper, in a direction indicated by the arrow S shown in FIG. 5 so as to move the recording medium P onto the protective layer 25 located on the plurality of heat generating sections 9 of the thermal head X1. The driving section functions to drive the conveying rollers 43, 45, 47 and 49, and, for example, a motor may be used for the driving section. For example, the conveying roller 43, 45, 47, 49 is composed of a cylindrical shaft body 43*a*, 45*a*, 47*a*, 49*a* formed of metal such as stainless steel covered with an elastic member 43*b*, 45*b*, 47*b*, 49*b* formed of butadiene rubber, for example. Although not shown in the drawing, when using ink-transferable image-receiving paper or the like as the recording medium P, the recording medium P is conveyed together with an ink film which lies between the recording medium P and the heat generating section 9 of the thermal head X1.

The platen roller 50 functions to press the recording medium P against the top of the protective layer 25 located on the heat generating section 9 of the thermal head X1. The platen roller 50 is disposed so as to extend along a direction perpendicular to the conveying direction S of the recording medium P, and is fixedly supported at ends thereof so as to be rotatable while pressing the recording medium P against the top of the heat generating section 9. For example, the platen roller 50 may be composed of a cylindrical shaft body 50*a* formed of metal such as stainless steel covered with an elastic member 50*b* formed of butadiene rubber, for example.

The power-supply device 60 functions to supply electric current for enabling the heat generating section 9 of the thermal head X1 to generate heat as described above, as well as electric current for operating the driving IC 11. The control unit 70 functions to feed a control signal for controlling the operation of the driving IC 11 to the driving IC 11 in order to cause the heat generating sections 9 of the thermal head X1 to selectively generate heat as described above.

The thermal printer Z1 performs predetermined printing on the recording medium P by, while pressing the recording medium P against the top of the heat generating section 9 of the thermal head X1 by the platen roller 50, conveying the recording medium P onto the heat generating section 9 by the conveyance mechanism 40, and also operating the power-supply device 60 and the control unit 70 so as to enable the heat generating sections 9 to selectively generate heat. When using image-receiving paper or the like as the recording medium P, printing on the recording medium P is performed by thermally transferring the ink of the ink film (not shown), which is conveyed together with the recording medium P, onto the recording medium P.

Second Embodiment

Figure 6:
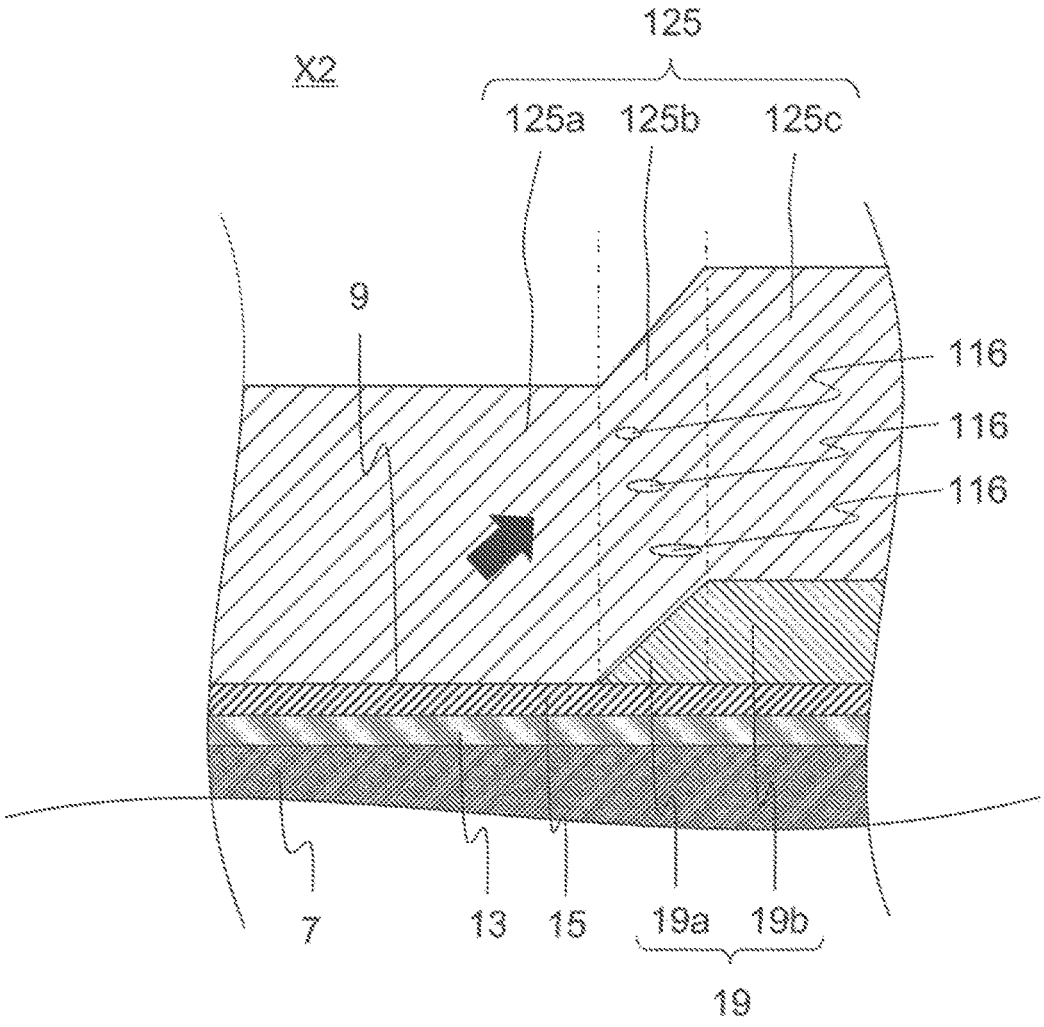
FIG. 6 is a sectional view corresponding to FIG. 4, illustrating a thermal head according to a second embodiment.

A thermal head X2 will be described with reference to FIG. 6. The same members as those of the thermal head X1 will be identified with the same reference symbols throughout the following description. In the thermal head X2, a protective layer 125 and a first void 116 are structurally different from those of the thermal head X1.

A protective layer 125 has a first region 125*a*, a second region 125*b*, and a third region 125*c*.

Two or more first voids 116 are spaced apart from each other. More specifically, the two or more first voids 116 are spaced apart from each other in the thickness direction of the substrate 7. The first voids 116 lie only within the second region 125*b*. The first void 116 is surrounded by the second region 125*b* of the protective layer 125, and thus, the two or more first voids 116 are each present in a closed state within the protective layer 125. That is, the first void 116 is spaced away from the connecting portion 19*a*, and also away from the surface of the protective layer 125.

Figure 5:
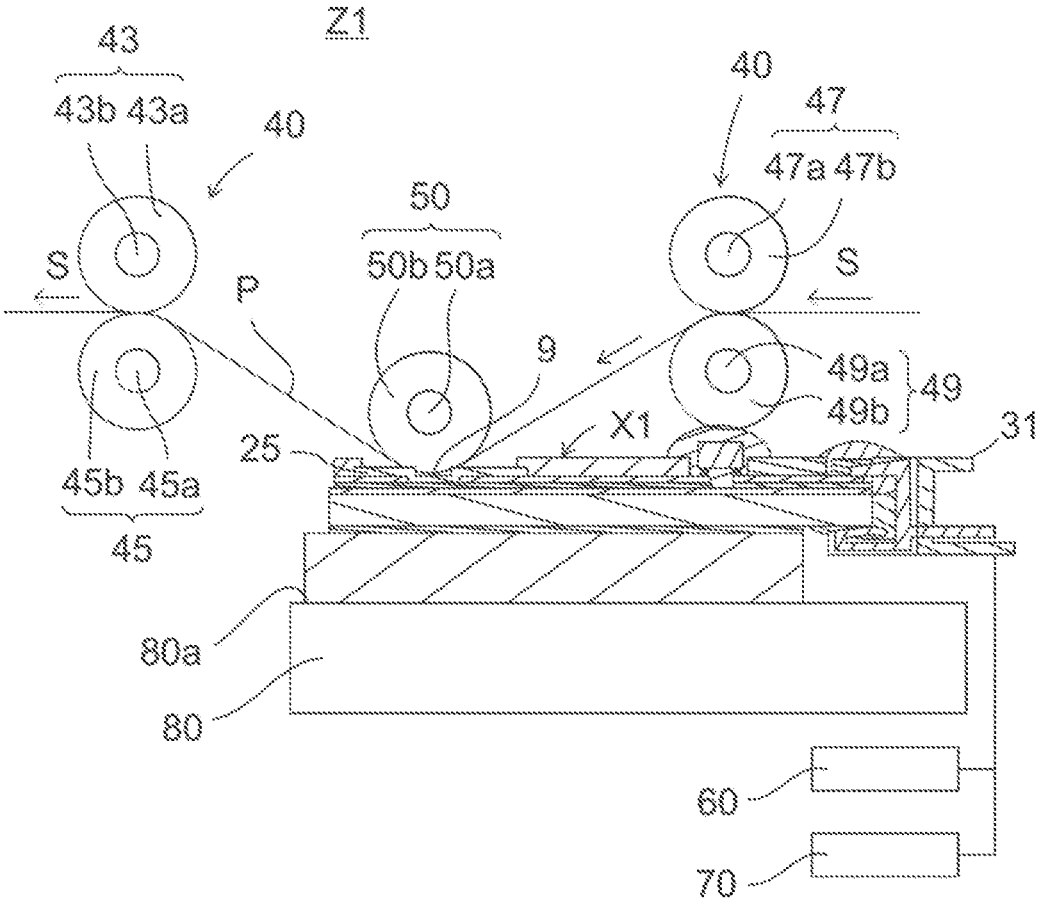
FIG. 5 is a schematic drawing showing a thermal printer according to the first embodiment.

Since the two or more first voids 116 are spaced apart from each other, it is possible to relax a compressive stress exerted upon the protective layer 125 by the pressing action of the platen roller 50 (refer to FIG. 5). Moreover, the large first void 116 does not occur in the thickness direction of the substrate 7, and a low-rigidity part is less likely to occur within the second region 125*b*. The two or more first voids 116 serve to relax a compressive stress induced by pressing action, and thus damage is less likely to occur in the protective layer 125.

Moreover, the first void 116 is elongated in the sub-scanning direction. This makes it possible to shorten the length of the first void 116 in the thickness direction of the substrate 7 without a reduction in cross-sectional area, and thereby the large first void 116 is less likely to occur in the thickness direction of the substrate 7. In consequence, damage is less likely to occur in the protective layer 125.

Moreover, cross-sectional areas of the first voids 116 increase with decreasing distance from the heat generating section 9. This makes it possible to achieve efficient insulation of part of the heat generated in the heat generating section 9, as well as to allow the first voids 116 to effect relaxation of a compressive stress exerted upon the protective layer 125.

Moreover, the first void 116 is present in the second region 125*b* alone, but is not present in the first region 125*a*. This makes it possible to suppress that the heat generated in the heat generating section 9 is less likely to be transmitted to the recording medium P (refer to FIG. 5), wherefore the thermal head X2 suffers little from deterioration in thermal efficiency.

In forming the protective layer 125, for example, a film of the protective layer 125 is formed by screen printing technique, and, after the formation of the film of the protective layer 125, a volatile binder is applied, in a predetermined area, to a region where the first void 116 is to be formed. After that, another film of the protective layer 125 is further formed by the screen printing technique. Following the repetition of these process steps, firing operation is performed for completion of the protective layer 125.

Third Embodiment

Figure 7:
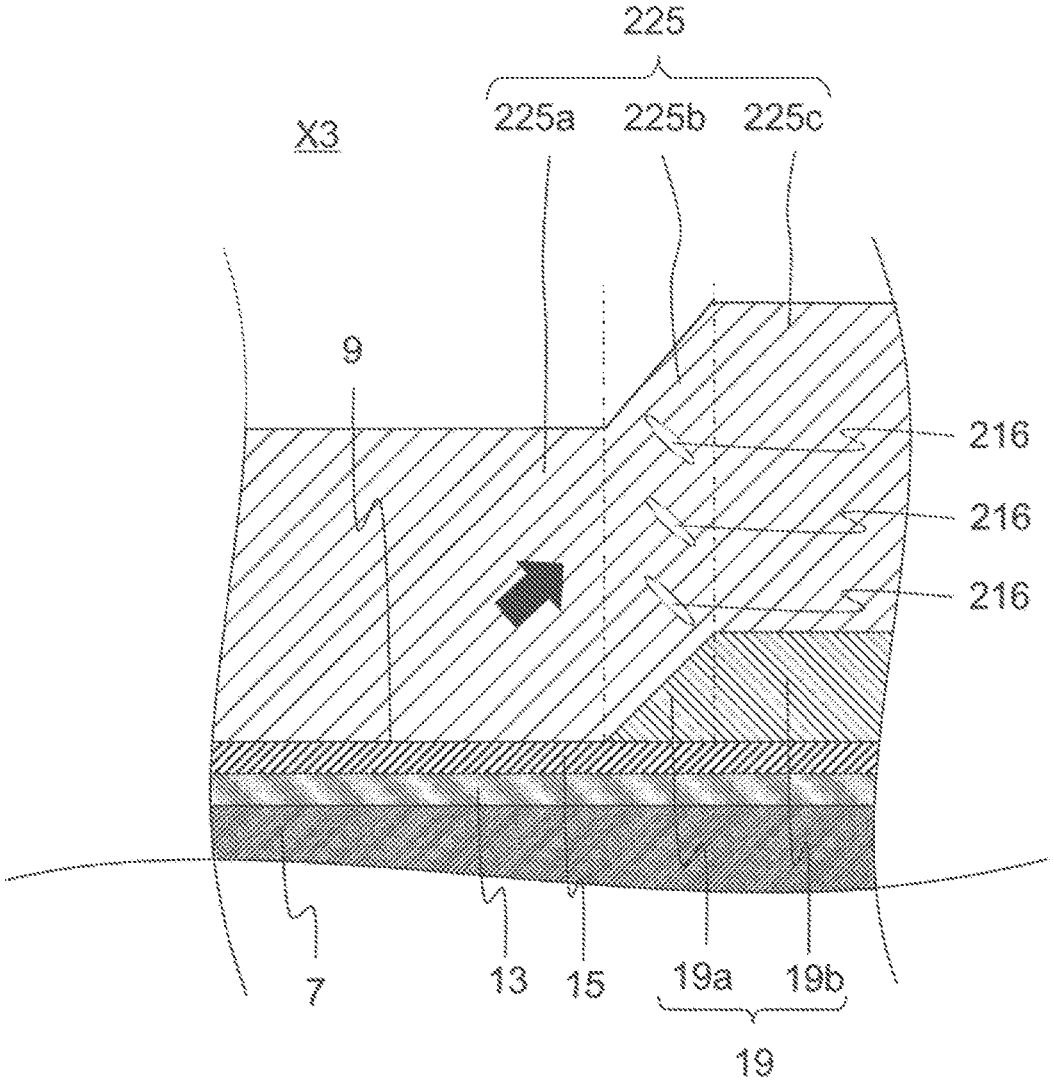
FIG. 7 is a sectional view corresponding to FIG. 4, illustrating a thermal head according to a third embodiment.

A thermal head X3 will be described with reference to FIG. 7. In the thermal head X3, a protective layer 225 and a first void 216 are structurally different from those of the thermal head X1.

The discrete electrode 19 comprises a connecting portion 19*a* and a wiring portion 19*b*. A protective layer 225 has a first region 225*a*, a second region 225*b*, and a third region 225*c*.

Two or more first voids 216 are spaced apart from each other in the thickness direction of the substrate 7. The first voids 216 are each formed so as to perpendicularly extend with respect to the slanted surface of the connecting portion 19*a*. As employed herein "perpendicularly extend with respect to the surface of the connecting portion 19*a*" means "arranged inclined at an angle of 75° to 105° to the surface of the connecting portion 19*a*".

In the thermal head X3, the first void 216 is formed so as to perpendicularly extend with respect to the surface of the connecting portion 19*a*. Thus, the first void 216 is configured to extend substantially perpendicular to the direction of transmission of heat generated in the heat generating section 9.

In consequence, the heat-insulating capability of the first void 216 can be enhanced, and the possibility of transmission of part of the heat produced in the heat generating section 9 to the second region 225*b* can be reduced. Therefore, part of the heat generated in the heat generating section 9 is less likely to be dissipated from the discrete electrode 19.

Cross-sectional areas of the first voids 216 may increase with decreasing distance from the heat generating section 9. Also in this case, part of the heat generated in the heat generating section 9 can be insulated efficiently, and, a compressive stress exerted upon the protective layer 225 can be relaxed by the first void 216.

Moreover, Since the first void 216 is shaped so that a longitudinal side thereof extends in the sub-scanning direction, it is possible to disperse, in the sub-scanning direction, a compressive stress developed by the pressing action of the platen roller 50 (refer to FIG. 5) while relaxing the compressive stress. Thereby, damage is less likely to occur in the protective layer 225.

For example, the protective layer 225 may be formed by the following procedure.

On the substrate 7 patterned with the various electrodes, the protective layer 225 is formed by sputtering technique. To begin with, the protective layer 25 is formed by non-bias sputtering technique. At this time, due to the stepped configuration defined by the connecting portion 19*a* of the discrete electrode 19, the first void 216 is created near the boundary between the first region 225*a* and the second region 225*b*.

Next, with use of a polishing apparatus, lapping operation is performed on a region wider than the stepped part created near the heat generating section 9. The region subjected to the lapping operation is substantially equal in area to the first void 216-bearing region, as seen in plan view. Subsequently, the protective layer 225 is formed using the non-bias sputtering technique, followed by lapping operation.

Lastly, the protective layer 225 is formed by bias sputtering technique. In the case of forming the protective layer 225 by the bias sputtering technique, a dense protective layer 225 can be formed on the first void 216. This makes it possible to form the first void 216 which is not in communication with the outside.

Fourth Embodiment

Figure 8:
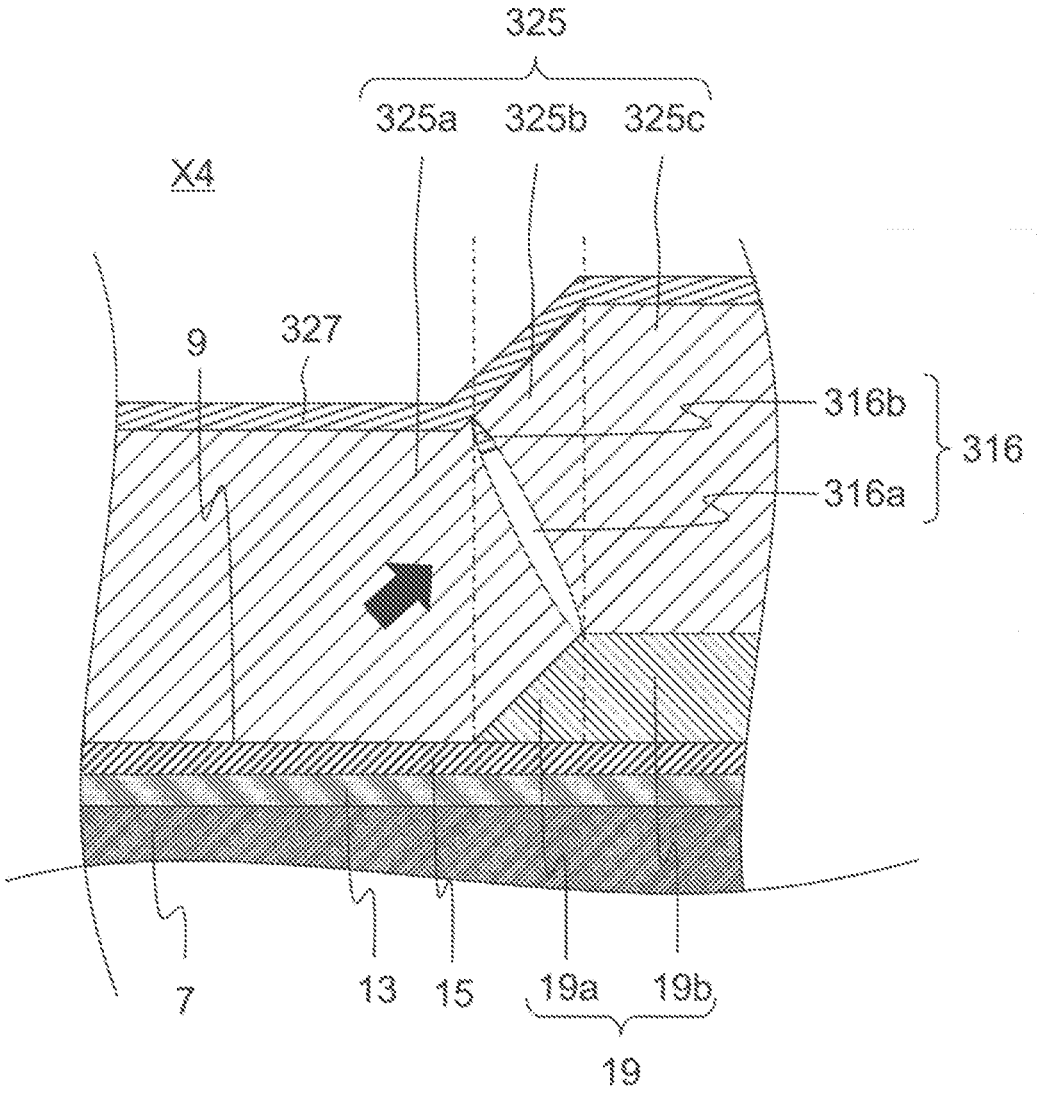
FIG. 8 is a sectional view corresponding to FIG. 4, illustrating a thermal head according to a fourth embodiment.

A thermal head X4 will be described with reference to FIG. 8. In the thermal head X4, a first void 316 is structurally different from that of the thermal head X1, and, the thermal head X4 further comprises a cover layer 327.

The cover layer 327 is located on a first region 325*a*, a second region 325*b*, and a third region 325*c* of a protective layer 325. The cover layer 327 may be formed of a resin material such as epoxy resin, polyimide resin, or silicone resin, and, a thickness thereof is preferably adjusted to 0.01 μm to 1 μm. The cover layer 327 does not necessarily have to be located on the first region 325*a*.

The first void 316 comprises a closed pore portion 316*a* and a seal portion 316*b*. The closed pore portion 316*a* is provided in the second region 325*b*, and constitutes the closed first void 316 in the protective layer 325. Hence, the first void 316 is configured to be lower in thermal conductivity than the second region 325*b*, and thus serves as a heat-insulating portion within the second region 325*b*.

The seal portion 316*b* is disposed in the second region 325*b* of the protective layer 325, and is constituted by the cover layer 327. The seal portion 316*b* is made continuous with the closed pore portion 316*a* so as to seal the closed pore portion 316*a*.

In the thermal head X4, the cover layer 327 is disposed so as to cover the protective layer 325, and part of the cover layer 327 located above the first void 316, and, air is contained in a lower part of the first void 316. Hence, the closed pore portion 316*a* can be formed simply by applying the cover layer 327 after the formation of the protective layer 325.

Fifth Embodiment

Figure 9:
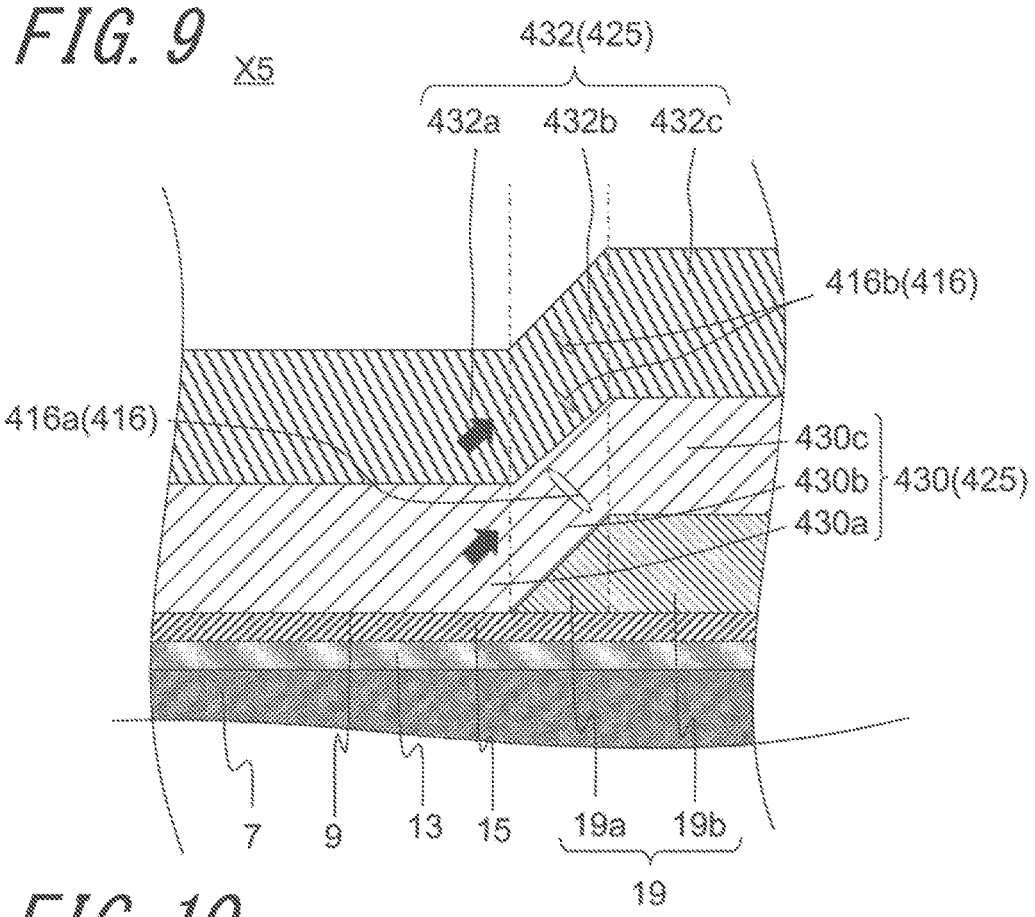
FIG. 9 is a sectional view corresponding to FIG. 4, illustrating a thermal head according to a fifth embodiment.

A thermal head X5 will be described with reference to FIG. 9. In the thermal head X5, a protective layer 425 and a first void 416 are structurally different from those of the thermal head X1.

The protective layer 425 comprises a first protective layer 430 and a second protective layer 432. The first protective layer 430 is disposed so as to cover the common electrode 17 close to the heat generating section 9 (refer to FIG. 1), the discrete electrode 19 close to the heat generating section 9, and the heat generating section 9. The first protective layer 430 has a first region 430*a*, a second region 430*b*, and a third region 430*c*. The first region 430*a* is a region located on the heat generating section 9. The second region 430*b* is a region located on the connecting portion 19*a*. The third region 430*c* is a region located on the wiring portion 19*b*.

The second protective layer 432 is located on the first protective layer 430. The second protective layer 432 has a first region 432*a*, a second region 432*b*, and a third region 432*c*. The first region 432*a* is a region located above the heat generating section 9. The second region 432*b* is a region located above the connecting portion 19*a*. The third region 432*c* is a region located above the wiring portion 19*b*.

The first protective layer 430 has a closed first void 416*a* which is located above the connecting portion 19*a* and is provided therein. The first void 416*a* is provided only within the second region 430*b*, and is formed so as to perpendicularly extend with respect to the surface of the connecting portion 19*a*. Around the first void 416*a*, the second region 430*b* of the first protective layer 430 is provided, and the first void 416*a* is not exposed to the outside.

The second protective layer 432 has a closed second void 416*b* which is located above the connecting portion 19*a* and is provided therein. The second void 416*b* is provided only within the second region 432*b*, and is formed so as to perpendicularly extend with respect to the surface of the connecting portion 19*a*. Around the second void 416*b*, the second region 432*b* of the second protective layer 432 is provided, and the second void 416*b* is not exposed to the outside.

In the presence of the first void 416*a* and the second void 416*b*, the heat generated in the heat generating section 9 can be less likely to be dissipated, through the protective layer 425, toward the discrete electrode 19.

Since none of the first void 416*a* is in communication with the second void 416*b*, moisture, etc. is less likely to intrude into the first void 416*a* from the outside of the protective layer 425, and therefore the heat-insulating capabilities of the first void 416*a* and the second void 416*b* can be maintained. Moreover, moisture, etc. is less likely to intrude into the first void 416*a* and the second void 416*b* from the outside, and therefore the sealability of the protective layer 425 can be ensured, and thus corrosion is less likely to occur in the common electrode 17 and the discrete electrode 19.

That is, even if the second void 416*b* is brought into communication with the outside as the protective layer 425 wears down, the first void 416*a* can be maintained in an internally closed state without communication with the outside. Thus, in virtue of the first void 416*a*, the heat generated in the heat generating section 9 can less likely to be dissipated, through the protective layer 425, toward the discrete electrode 19.

Moreover, the second void 416*b* is located above the first void 416*a*, as seen in sectional view. Thus, the first void 416*a* and the second void 416*b* are located above the connecting portion 19*a*. This allows the second region 430*b* of the first protective layer 430 and the second region 432*b* of the second protective layer 432 to effect heat insulation, and thus a structure in which the heat generated in the heat generating section 9 is less likely to be dissipated can be achieved.

Moreover, the first void 416*a* is larger in cross-sectional area than the second void 416*b*, as seen in sectional view. Thus, the first void 416*a* having a larger cross-sectional area permits effective reduction in dissipation of the heat generated in the heat generating section 9, and also, a pressing force exerted by the platen roller 50 (refer to FIG. 5) can be dispersed in the presence of the second void 416*b* having a smaller cross-sectional area.

That is, the first void 416*a* close to the heat generating section 9 can achieve effective heat insulation, and the second void 416*b* close to the platen roller 50 can achieve effective stress dispersion. In consequence, the thermal head X5 exhibits improved thermal responsiveness and resistance to damage.

Sixth Embodiment

Figure 10:
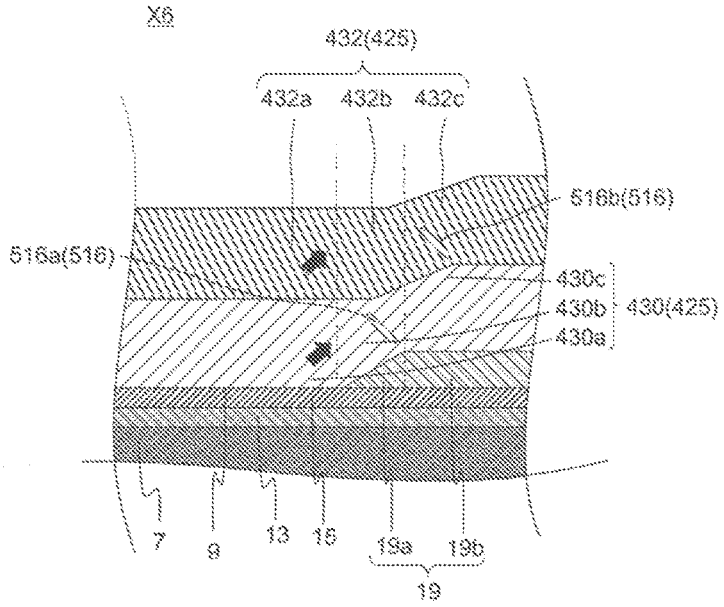
FIG. 10 is a sectional view corresponding to FIG. 4, illustrating a thermal head according to a sixth embodiment.

A thermal head X6 will be described with reference to FIG. 10. In the thermal head X5, a first void 516 is structurally different from that of the thermal head X5.

The first protective layer 430 has a closed first void 516*a* which is located above the connecting portion 19*a* and is provided therein. The first void 516*a* is provided only within the second region 430*b*, and is formed so as to perpendicularly extend with respect to the surface of the connecting portion 19*a*. Around the first void 516*a*, the second region 430*b* of the first protective layer 430 is provided, and the first void 516*a* is not exposed to the outside.

The second protective layer 432 has a closed second void 516*b* which is located above the wiring portion 19*b* and is provided therein. The second void 516*b* is provided only within the third region 432*c*, and is formed so as to perpendicularly extend with respect to the surface of the connecting portion 19*a*. Around the second void 516*b*, the third region 432*c* of the second protective layer 432 is provided, and the second void 516*b* is not exposed to the outside.

With this arrangement, the second void 516*b* is deviated from above the first void 516*a* on the driving IC 11 side, as seen in sectional view. In consequence, the thermal head X6 is less likely to damaged by the pressing force exerted by the platen roller 50 (refer to FIG. 5).

That is, if the second void 516*b* is positioned above the first void 516*a*, the strengths of the second regions 430*b* and 432*b* bearing the first void 516*a* and the second void 516*b* may be decreased. However, by placing the second void 516*b* so as to be deviated from the first void 516*a*, the strength of the protective layer 425 can be maintained at a high level. In consequence, the thermal head X6 becoming resistant to damage can be achieved.

While one embodiment of the invention has been described heretofore, it should be understood that the invention is not limited to the above-described embodiments, and that many modifications and variations may be possible without departing from the scope of the invention. For example, although the thermal printer Z1 employing the thermal head X1 according to the first embodiment has been shown herein, the invention is not limited to this, and thus, the thermal heads X2 to X6 may be adopted for use in the thermal printer Z1. Moreover, the thermal heads X1 to X6 according to a plurality of embodiments may be used in combination.

For example, although the thin-film head having the thin heat generating section 9 obtained by forming the electrical resistance layer 15 in thin-film form has been described as exemplification, the invention is not limited to this. The invention may be embodied as a thick-film head having a thick heat generating section 9 by forming the electrical resistance layer 15 in thick-film form.

Moreover, although a flat-type head in which the heat generating section 9 is formed on the first principal surface 7*f* of the substrate 7 has been described as exemplification, the invention may be embodied as an edge-type head in which the heat generating section 9 is disposed on an end face of the substrate 7.

Moreover, the heat storage layer 13 may be provided with an underlayer portion 13 which is located in other region than a region where the protuberance 13*a* is formed. The heat generating section 9 may be configured by forming the common electrode 17 and the discrete electrode 19 on the heat storage layer 13, and thereafter forming the electrical resistance layer 15 only in a region between the common electrode 17 and the discrete electrode 19.

The sealing member 12 and the hard coating 29 which covers the driving IC 11 may be formed of the same material. In this case, the hard coating 29 and the sealing member 12 may be concurrently formed by performing printing on a region where the sealing member 12 is to be formed when the hard coating 29 is printed.

REFERENCE SIGNS LIST

X1-X6: Thermal head
Z1: Thermal printer
1: Heat-dissipating plate
3: Head base body
7: Substrate
9: Heat generating section
11: Driving IC
12: Sealing member
13: Heat storage layer
14: Bonding member
16, 116, 216, 316, 416, 516: First void
17: Common electrode
19: Discrete electrode
19*a*: Connecting portion
19*b*: Wiring portion
25, 125, 225, 325, 425: Protective layer
25*a*, 125*a*, 225*a*, 325*a*, 425*a*: First region
25*b*, 125*b*, 225*b*, 325*b*, 425*b*: Second region
25*c*, 125*c*, 225*c*, 325*c*, 425*c*: Third region
27, 327: Cover layer
31: Connector

The invention claimed is:

1. A thermal head, comprising:
a substrate;
a heat generating section disposed on the substrate;
an electrode disposed on the substrate, the electrode comprising
a connecting portion connected to the heat generating section; and
a first protective layer which covers the heat generating section and the connecting portion of the electrode,
a part of the first protective layer which is disposed on the connecting portion comprising
a closed first void, the closed first void extending in a thickness direction of the substrate.

2. The thermal head according to claim 1, wherein the closed first void contains a gas therein.

3. The thermal head according to claim 1, further comprising
a closed second void which is spaced apart from the closed first void.

4. The thermal head according to claim 1, wherein
the connecting portion of the electrode is shaped so that a thickness thereof becomes smaller gradually with approach toward the heat generating section, and
the closed first void perpendicularly extends with respect to a surface of the connecting portion, as seen in sectional view of the thermal head.

5. The thermal head according to claim 1, further comprising:
a cover layer covering the first protective layer,
wherein part of the cover layer is located above the first void, and air is contained in a lower part of the first void.

6. A thermal printer, comprising:
the thermal head according to claim 1;
a conveyance mechanism which conveys a recording medium onto the heat generating section; and
a platen roller which presses the recording medium against a top of the heat generating section.

7. A thermal head comprising:
a substrate;
a heat generating section disposed on the substrate;
an electrode disposed on the substrate, the electrode comprising
a connecting portion connected to the heat generating section; and
a first protective layer which covers the heat generating section and the connecting portion of the electrode,
a part of the first protective layer which is disposed on the connecting portion comprising a closed first void therein and a closed second void which is spaced apart from the closed first void in a thickness direction of the substrate,
a cross-sectional area of the closed second void larger than a cross-sectional area of the closed first void.

8. A thermal head, comprising:
a substrate;
a heat generating section disposed on the substrate;
an electrode disposed on the substrate, the electrode comprising a connecting portion connected to the heat generating section;

a first protective layer which covers the heat generating section and the connecting portion of the electrode; and a second protective layer disposed on the first protective layer, wherein the first protective layer is internally provided with the closed first void, and the second protective layer is internally provided with a closed third void.

9. The thermal head according to claim 8, wherein the closed third void is deviated from above the closed first void, as seen in sectional view of the thermal head.

10. The thermal head according to claim 8, wherein the third void is located above the first void, as seen in sectional view of the thermal head.

11. The thermal head according to claim 8, wherein the closed first void is larger in cross-sectional area than the closed third void.

* * * * *